United States Patent [19]

Cox

[11] Patent Number: 4,892,265

[45] Date of Patent: Jan. 9, 1990

[54] WRAP WINDER WITH REVERSIBLE MOUNTING BRACKET

[76] Inventor: Lloyd D. Cox, Rte. 2, Box 81A, Pratt, Kans. 67124

[21] Appl. No.: 237,055

[22] Filed: Aug. 26, 1988

[51] Int. Cl.[4] ..... B65H 17/46; A47B 96/06

[52] U.S. Cl. ..... 242/67.1 R; 242/86.52 R; 242/106; 248/223.4

[58] Field of Search ..... 242/67.1 R, 85, 86.5 R, 242/86.52, 106; 248/223.4, 225.1

[56] References Cited

U.S. PATENT DOCUMENTS

| | | | |
|---|---|---|---|
| 158,680 | 1/1875 | Cone . | |
| 409,447 | 8/1889 | Block . | |
| 437,554 | 9/1890 | Bellamy . | |
| 537,507 | 4/1895 | Waldron . | |
| 683,774 | 10/1901 | Kilbourn . | |
| 797,483 | 8/1905 | Wilkins . | |
| 1,359,021 | 11/1920 | Blair . | |
| 1,977,103 | 10/1934 | Wise . | |
| 2,571,175 | 10/1951 | Williams et al. . | |
| 2,610,014 | 9/1952 | Ananson | 248/223.4 |
| 2,926,879 | 3/1960 | Dietrich | 248/223.4 |
| 3,003,733 | 10/1961 | Peterson | 248/223.4 |
| 3,074,680 | 1/1963 | Stewart | 248/223.4 X |
| 3,998,402 | 12/1976 | Christensen . | |
| 4,266,740 | 5/1981 | Ramos et al. | 242/86.52 |

*Primary Examiner*—Joseph J. Hail, III
*Assistant Examiner*—Steven M. Dubois
*Attorney, Agent, or Firm*—Kokjer, Kircher, Bradley, Wharton, Bowman & Johnson

[57] ABSTRACT

Apparatus to roll elongated strips of material such as leg wraps used with horses. The winding device has a split spindle operated by a crank handle and a smoothing bar and roll forming disc. An integral mounting component is symmetrical in both the upright and inverted directions and fits in a vertical slot in a mounting bracket to permit orientation of the device for use either by right handed or left handed operators.

1 Claim, 1 Drawing Sheet

WRAP WINDER WITH REVERSIBLE MOUNTING BRACKET

This invention relates to bandage rollers, and more particularly to a roller ideally suited for re-rolling the leg bandages which are commonly used for wrapping the legs of horses.

It has long been a practice of horse handlers to wrap the legs of these animals for protecting the latter during certain activities. The bandages or "wraps" conventionally used for this purpose are relatively long strips of cloth material which may have a certain amount of resiliency yieldability or stretch so that a wrap may be wound in a spiral fashion around a horse's leg to fit snugly over the irregular leg contour. Wraps used for this purpose are often about four or five inches wide and may be about eight feet long or so to furnish enough length for wrapping an adequate distance along the leg.

Leg wraps are reused many times and must be re-rolled into a relatively tightly wound cylindrical shape or roll between applications. The wraps are applied to the horse's legs while the animal is standing and only application in rolled form is practical.

Leg wraps used for horses are often re-rolled after use by hand without the aid of any mechanical re-rolling apparatus. While bandage rollers have heretofore been suggested and are commonly used in connection with the packaging of sterile bandages and the like for medical uses, devices of this type have not been generally accepted for the purpose of rolling horse leg wraps. As a consequence, much time and effort is usually devoted to the task of re-rolling the leg wraps between successive applications.

One reason devices of this type have not been generally used in connection with horse stable operations is probably because horse leg wraps cannot readily be rolled at a fixed location. The wraps are often sweaty after use and must be left in an unrolled condition for drying. They are usually kept in relatively close proximity to the stall where the particular horse with which they are used is stabled. It is impractical to carry the wraps to a central location for winding, especially when the wraps are applied immediately before the horse is to be exercised as an integral step of the grooming sequence which must be carried out at the stall location.

Even it it were economical to provide a leg wrap re-rolling apparatus at each stall location for each horse, a fixedly mounted wrap rolling apparatus would likely interfere with other operations and could be dangerous if mounted in a location where it could be contacted by the horse. Further, the apparatus would, itself, be subject to breakage if mounted in a readily accessible position. Such problems are greatly exacerbated if the horse is kept in or at a trailer during operations away from home.

Bandage rollers which have heretofore been available are constructed for either right hand or left hand manual operation, not both. Any particular horse handler who may require use of such apparatus may be opposite handed for conveniently using a particular device available. This, too, may be an additional reason that devices of this type have not found acceptance for use with horse leg wraps and why these items are conventionally re-rolled tediously and laboriously by hand.

Accordingly, it is a primary object of the present invention to provide an apparatus for re-rolling relatively long, narrow strips of material such as leg wraps which overcomes the foregoing drawbacks and can be readily and economically made available for this purpose.

In the achievement of this objective, it is an important object of the invention to provide a wrap roller capable of portable installation wherein a single apparatus may be readily used at many different installations, yet which may be readily removed from any particular installation when not in use, leaving only an unobtrusive and safe mounting bracket at the installation.

Another very important object of the present invention is to provide a re-rolling apparatus of this kind which is constructed for equally convenient right or left handed operation so that it can be readily used by any operator.

Still a further object of the invention is to provide a roller which can be economically fabricated so that it may be made available to a large number of potential users and yet which is rugged and durable for reliable operation in and around a variety of other operations such as are carried out in connection with the care, training and transportation of horses.

Yet another object of the present invention is to provide a roller of the kind described having an easily fabricated, yet durable mounting bracket which cooperates with a mounting base on the rolling apparatus to removably secure the apparatus for use by either right or left handed persons so that it is practical to permanently mount a plurality of brackets at a variety of locations for use of the roller at whatever location may be required on any particular occasion.

These and other important aims and objectives of this invention will be further described or will become apparent from the description, claims and the drawing.

Figure 4:
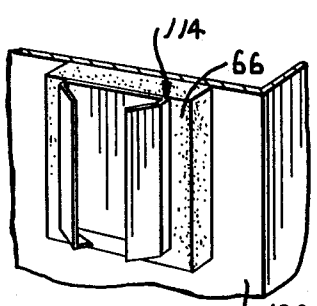
FIG. 4 is an enlarged perspective view of a mounting bracket installed on a metal member.

Apparatus embodying the principles of this invention is broadly designated in the drawing by the reference numeral 10 and includes a winding device 12 and a mounting bracket 14. Device 12 comprises an elongated, rigid frame 16 provided with a hub 18 proximal one end of the frame. Hub 18 has a transverse bore (not shown) in which is mounted an elongated, rigid, transversely circular spindle 20 for rotation about the axis of the spindle. A handle 22 in the form of a crank is rigidly secured to the end of the spindle projecting laterally from frame 16 in the direction opposition the projection of the major portion of the spindle. Handle 22 provides means for manual rotation of the spindle as will be readily understood.

Figure 3:
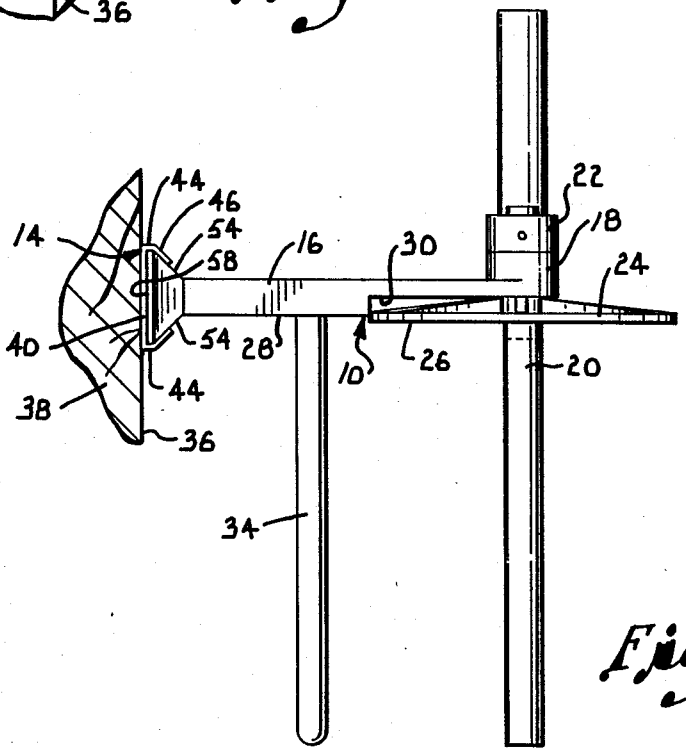
FIG. 3 is a top plan view of the apparatus.
Figure 1:
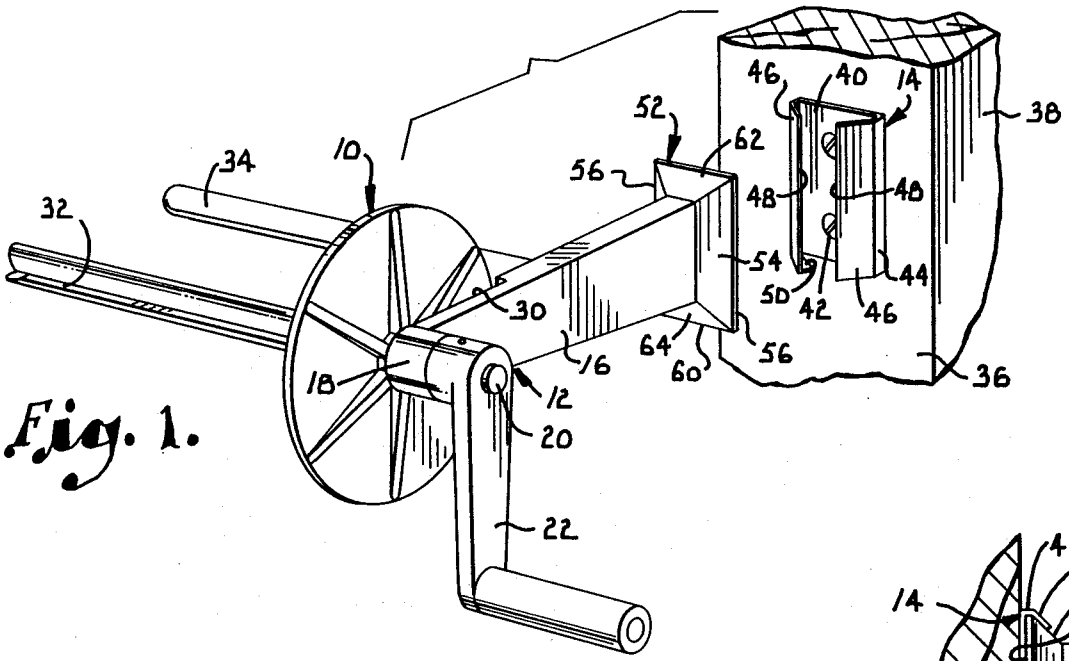
FIG. 1 is an exploded, fragmentary perspective view showing an apparatus embodying this invention with the mounting bracket installed on a wooden member.

A disc 24 having a flat surface 26 generally co-planar with the proximal side 28 of frame 16 is mounted on spindle 20 for rotation therewith. The diameter of disc 24 is generally the same or slightly greater than the diameter of the rolls of strip material contemplated to be wound by apparatus 10. Frame 16 is provided with a recess 30 to accommodate disc 24 with the flat surface 26 thereof substantially in the plane of the frame side 28. The portion of spindle 20 on the side of frame 16 opposite handle 22 is slotted along substantially its entire length by an elongated slot 32. Also, an elongated, rigid, preferably transversely circular smoothing bar 34 is rigidly mounted on frame 16 and projects outwardly in spaced apart parallelism with spindle 20 as shown clearly in FIG. 3 of the drawing.

Bracket 14 is adapted to releasably mount the winding device 12 to a support such as the flat surface 36 of a wooden member 38 which might be a part of the construction of a stable or other structure. Bracket 14 includes a substantially flat back plate 40 having apertures to receive screws 42 for mounting the bracket to the member. Bracket 14 is preferably bent from initially flat sheet material to provide parallel, integral sides 44, each side having its respective, integral flange 46 bent to extend forwardly and inwardly from the flat surface of back plate 40. The projecting side edges 48 of the respective flanges 46 are spaced apart and extend parallel to one another to define an upwardly opening, elongated, vertically extending slot for bracket 14. It should be noted that the transverse cross-sectional configuration of the slot in bracket 14 is generally T-shaped. The sheet material comprising flanges 46 is bent inwardly at the lowermost end of each flange to present a flange 50 integral with the lowermost end of each flange 46. The flanges 50 conjointly define a stop at the bottom of the slot of the bracket.

Means for releasably coupling the winding device 12 to bracket 14 comprises a rigid, elongated, component 52 carried by frame 16 at the end thereof remote from hub 18. Component 52 is preferably formed integral with frame 16 and shaped as illustrated in the drawing. Accordingly, the component includes a pair of flat, beveled side surfaces 54 presenting respective straight edges 56 which are parallel with one another and which are adapted to fit in the bracket slot with the edges engaged against the sides 44 of the bracket. The back surface of component 52 is substantially flat and engages the flat surface of back plate 40 while the beveled surfaces 54 of the component are engaged by the bracket flanges 46. The bottom edge 60 of the component rests on the flanges 50 of the bracket so that the device 12 is securely attached by the bracket to the mounting member 38.

It should be pointed out that the top of component 52 is substantially identical to the bottom of the component. Also, the respective sides of the component are substantially identical to one another. Accordingly, the winding device can be quickly and easily inserted into the bracket either in the orientation shown in the drawing or in an inverted orientation wherein the device is rotated 180 degrees from that shown. Obviously, in the latter orientation, the handle 22 projects in the opposite direction from that shown in the drawing. The top and bottom surfaces 62 and 64 of the mounting component are beveled as shown to facilitate the easy insertion of the component in the bracket slot in either orientation.

FIG. 4 of the drawing illustrates a modified form of bracket 114 which may be identical to bracket 14 except that the apertures for the mounting screws 42 are omitted. Bracket 114 is adapted for installation on a metal structural component 138 by any suitable means such as by welding or by means of an adhesive backed pad 66. Manifestly, any suitable means may be employed for securing the bracket to an appropriate support.

Figure 2:
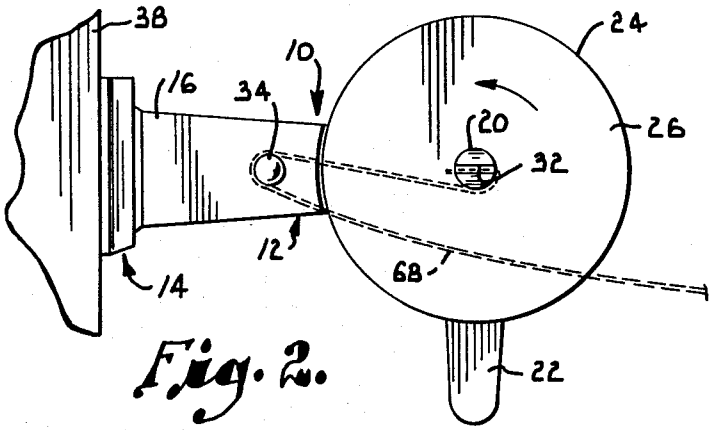
FIG. 2 is a fragmentary, side elevational view of the apparatus of FIG. 1, a strip of wrapping material threaded in the apparatus appearing in dashed lines.

In operation, the winding device 12 is installed in bracket 14 by insertion of the component 52 in the bracket slot. One end of an elongated strip 68 to be wound is inserted in the slot 32 of spindle 20 as shown in FIG. 2 of the drawing. The strip is passed over the smoothing bar 34 and the spindle is turned by manual manipulation of handle 22 to wind the strip into a roll. The flat surface 26 of disc 24 provides an abutment for one edge of the strip during the winding process. This, in conjunction with the smoothing of the strip by bar 34, ensures that the strip is wound into a compact, essentially cylindrical roll. Once the strip is completely rolled, it can be easily moved by sliding off the split projecting end of the spindle.

The configuration of component 52, in cooperation with the construction of bracket 14, permits the use of the winding apparatus by either left handed or right handed operators. If the apparatus is to be used by a left handed person, the winding device is merely inserted into the bracket slot in an inverted orientation from that shown in the drawing.

The winding apparatus of this invention is ideally suited for use in connection with horse operations wherein it is not feasible to permanently mount the apparatus at a fixed location. The apparatus can be kept in a tack box or with other grooming equipment until needed. The operator can remove the apparatus from its safe storage location and quickly and easily install the apparatus on any of a number of mounting brackets which may be permanently installed at or around the stall site or other convenient locations. Irrespective of whether the operator be left handed or right handed, the winding apparatus can be used to roll the wraps to facilitate the installation of the wraps on the horse's legs.

Once the wraps have been wound into cylindrical rolls, the winding apparatus can be removed from the bracket by a simple lifting movement and the apparatus can be returned to its safe storage location or passed to another stall for use by the same or a different operator to roll the wrappings for another horse. The mounting brackets which are permanently located at the stall or other site do not project sufficiently from the mounting surface to pose any danger to the animals or to provide obstructions interfering with the handling operations. Further, the apparatus is not likely to become broken or damaged as would be probable if the entire apparatus were mounted permanently in a projecting position in the area of animal handling operations.

The extreme portability of the apparatus of this invention renders it particularly suitable for use in connection with operations where horses are to be transported. For example, the brackets 14 or 114 can be readily mounted at a convenient location on a horse trailer or the like. The winding device which is stored for convenient transportation with other necessary gear can be readily installed in the bracket when the trailer has arrived at its destination. The winding device is, of course, removed after use for safe storage and to permit the trailer to be safely operated without danger of the device being broken or lost or causing damage during transit.

The construction of the apparatus of this invention may be largely with the use of relatively light, strong materials. The brackets can be economically fabricated from inexpensive, yet strong materials such as sheet steel or the like. Such fabrication of the apparatus components is calculated to hold down the overall cost of the apparatus so that it can be made available to a large number of handlers who have conventionally rolled leg wraps by hand prior to each installation operation.

Whereas the invention has been particularly described in connection with the rolling of leg wraps used for horses, it will be apparent to those skilled in the art that it need not be so limited. The invention may be used advantageously wherever it is necessary to wind elongated strips of flexible material into roll form. Accordingly, for example, winders constructed pursuant to the principles herein described can be used to excellent advantage in hospitals, athletic rooms, veterinary clinics and in other operations where strips are wound into rolls such as at government facilities or the like.

Having thus described the invention, I claim:

1. Apparatus for rolling elongated, flexible leg wraps to facilitate the application of wraps to horses, said apparatus comprising:

an elongated, rigid frame rotatably mounting a winding spindle projecting from one side of the frame and a handle for turning the spindle projecting from the opposite side of the frame;

a mounting bracket adapted to be secured to a support for mounting the frame in outwardly projecting relationship from said member, said bracket comprising a substantially rigid element having a back section with a substantially flat major surface and a back surface, said element being adapted to be secured to said member, said bracket having a pair of forwardly extending planar side sections integral with the back section and projecting forwardly therefrom, said side sections being inclined inwardly toward one another and terminating in parallel, vertically extending edges with the edge of each side section spaced from the edge of the other side section whereby said side sections and the back section conjointly define a generally T-shaped, vertically extending slot open at the top and front of the bracket, the latter including a restriction adjacent the bottom of the slot, the sides of said slot being defined by said inclined planar side sections of the bracket and the back of the slot being defined by said flat major surface; and an elongated, rigid component rigidly carried by the frame at one end of the latter for complemental insertion of the component longitudinally in the slot from the open upper end thereof for releasably securing the component and frame together to mount the frame to the member when the component is in said slot, said component having a flat face engageable with the bracket major surface and a pair of forwardly and inwardly beveled side shoulders engageable with the slot defining edges of said bracket side sections when the component is in said slot, the component being longitudinally symmetrical to permit insertion of the component into the slot from either end of the component so that the frame may be mounted on the member in disposition with the handle and spindle projecting in either of two selected directions from the frame, said bracket restriction comprising a flange on each bracket side section respectively, each respective flange projecting inwardly toward said bracket flat major surface and terminating in an edge at the bottom of said slot extending in spaced apart relationship from said flat major surface, and wherein said component has forwardly and inwardly beveled end shoulders on the respective ends of the component, a corresponding one of said end shoulders being adapted to engage the edges of said flanges when the component is installed in said slot.

* * * * *